US010207781B2

(12) United States Patent
Ito et al.

(10) Patent No.: US 10,207,781 B2
(45) Date of Patent: Feb. 19, 2019

(54) PROPELLER UNIT OF MARINE PROPULSION APPARATUS

(71) Applicant: SUZUKI MOTOR CORPORATION, Hamamatsu-shi, Shizuoka (JP)

(72) Inventors: Kunitoshi Ito, Hamamatsu (JP); Shuichi Sugiyama, Hamamatsu (JP); Hiroki Okunishi, Hamamatsu (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 0 days.

(21) Appl. No.: 15/860,941

(22) Filed: Jan. 3, 2018

(65) Prior Publication Data

US 2018/0208285 A1 Jul. 26, 2018

(30) Foreign Application Priority Data

Jan. 26, 2017 (JP) ..... 2017-011864

(51) Int. Cl.
*B63H 1/20* (2006.01)
*B63H 23/34* (2006.01)

(52) U.S. Cl.
CPC ..... *B63H 1/20* (2013.01); *B63H 23/34* (2013.01); *B63H 2023/342* (2013.01); *B63H 2023/346* (2013.01)

(58) Field of Classification Search
CPC ... B63H 1/04; B63H 1/06; B63H 1/20; B63H 21/30; B63H 23/00; B63H 23/34; F16D 1/06
USPC ..... 440/49, 52; 416/134 R
See application file for complete search history.

(56) References Cited

U.S. PATENT DOCUMENTS 4,642,057 A 2/1987 Frazzell et al.
5,244,348 A * 9/1993 Karls ..... B63H 23/34 416/134 R
6,672,834 B2 * 1/2004 Chen ..... B63H 23/34 416/134 R
7,086,836 B1 * 8/2006 Sheth ..... B63H 23/34 416/134 R
7,717,678 B2 * 5/2010 Chen ..... B63H 23/34 416/134 R
9,840,314 B2 * 12/2017 Kuroki ..... B63H 23/34

FOREIGN PATENT DOCUMENTS

JP S60234098 A 11/1985

* cited by examiner

*Primary Examiner* — Lars A Olson
(74) *Attorney, Agent, or Firm* — Troutman Sanders LLP

(57) ABSTRACT

A propeller unit of a marine propulsion apparatus includes: an inner hub; an outer hub arranged coaxially with the inner hub, connected to the inner hub, and provided with a plurality of blades on its outer circumferential surface; and a bushing having a hollow shaft member provided with ribs on an outer circumferential surface and connected to the propeller shaft, and a damper formed of an elastic member and arranged to cover an outer circumferential surface of the hollow shaft member between the outer circumferential surface of the hollow shaft member and the inner circumferential surface of the inner hub, wherein the bushing is spline-coupled to the propeller shaft through spline teeth formed on an inner circumferential surface of a front half or rear half of a longitudinal direction of the hollow shaft member, and has a breakable portion provided in a part corresponding to the non-spline-toothed portion.

5 Claims, 7 Drawing Sheets

PROPELLER UNIT OF MARINE PROPULSION APPARATUS

CROSS-REFERENCE TO RELATED APPLICATIONS

This application is based upon and claims the benefit of priority of the prior Japanese Patent Application No. 2017-011864, filed on Jan. 26, 2017, the entire contents of which are incorporated herein by reference.

BACKGROUND OF THE INVENTION

Field of the Invention

The present invention relates to a propeller unit of a marine propulsion apparatus (outboard motor) having a propeller provided with a shock absorbing capability.

Description of the Related Art

For example, Patent Document 1 discusses a propeller installation device including: A) a sleeve member provided with a plurality of protrusions installed in an axial direction to extend outward in a radial direction and an inner hole driven by and engaged with a propeller shaft; B) a propeller provided with an outer hub, an inner hub, and a plurality blades that connects the inner and outer hubs to form an exhaust gas path therebetween, the inner tube having a center hollow penetrating the inner hub and a plurality of channels provided on a wall surface of the center hollow to extend outward in a radial direction between the blades, the protrusions of the sleeve member being loosely fitted to the channels; and C) a cushioning member that surrounds the sleeve member and is fitted between the sleeve member and the inner hub of the propeller in a nested state, the cushioning member being engaged with the channels and the wall surfaces of the protrusions and including a space between the trench and the wall surfaces of the protrusions.

Patent Document 1: Japanese Laid-open Patent Publication No. 60-234098

In the apparatus discussed in Patent Document 1, irregularity in the shock absorbing performance of the shock absorber provided in the propeller of the marine propulsion apparatus can be reduced. However, the effect of suppressing irregularity in the shock absorbing performance is not stabilized. If the irregularity suppressing effect is negligible, an excessive load may be applied to the power transmission apparatus that applies power to the propeller. Therefore, it is difficult to promote effective protection of the power transmission apparatus and the like in this situation.

SUMMARY OF THE INVENTION

In view of the aforementioned problems, it is therefore an object of the invention to provide a propeller unit of a marine propulsion apparatus capable of reliably guaranteeing protection of the power transmission apparatus and the like.

According to an aspect of the present invention, there is provided a propeller unit connected to a propeller shaft of the marine propulsion apparatus, including: an inner hub; an outer hub arranged coaxially with the inner hub, connected to the inner hub, and provided with a plurality of blades on its outer circumferential surface; and a bushing having a hollow shaft member provided with ribs on an outer circumferential surface and connected to the propeller shaft, and a damper formed of an elastic member and arranged to cover an outer circumferential surface of the hollow shaft member between the outer circumferential surface of the hollow shaft member and the inner circumferential surface of the inner hub, wherein the bushing is spline-coupled to the propeller shaft through spline teeth formed on an inner circumferential surface of a front half or rear half of a longitudinal direction of the hollow shaft member, and has a breakable portion provided in a part corresponding to the non-spline-toothed portion.

DETAILED DESCRIPTION OF THE PREFERRED EMBODIMENTS

A propeller unit of a marine propulsion apparatus according to an embodiment of the invention will now be described with reference to the accompanying drawings.

A propeller unit of a marine propulsion apparatus according to an embodiment of the invention is a propeller unit connected to a propeller shaft of the marine propulsion apparatus and includes an inner hub; an outer hub arranged coaxially with the inner hub, connected to the inner hub, and provided with a plurality of blades on its outer circumferential surface; and a bushing having a hollow shaft member provided with ribs on an outer circumferential surface and connected to the propeller shaft, and a damper formed of an elastic member and arranged to cover an outer circumferential surface of the hollow shaft member between the outer circumferential surface of the hollow shaft member and the inner circumferential surface of the inner hub, wherein the bushing is spline-coupled to the propeller shaft through spline teeth formed on an inner circumferential surface of a front half or rear half of a longitudinal direction of the hollow shaft member, and has a breakable portion provided in a part corresponding to the non-spline-toothed portion.

In the propeller unit of the marine propulsion apparatus according to the present invention, when an excessive load is applied to the propeller during sailing, the breakable portion provided in the part corresponding to the non-spline-toothed portion serves as a so-called safety fuse. That is, the hollow shaft member is broken to protect the power transmission system.

EMBODIMENTS

Figure 1:
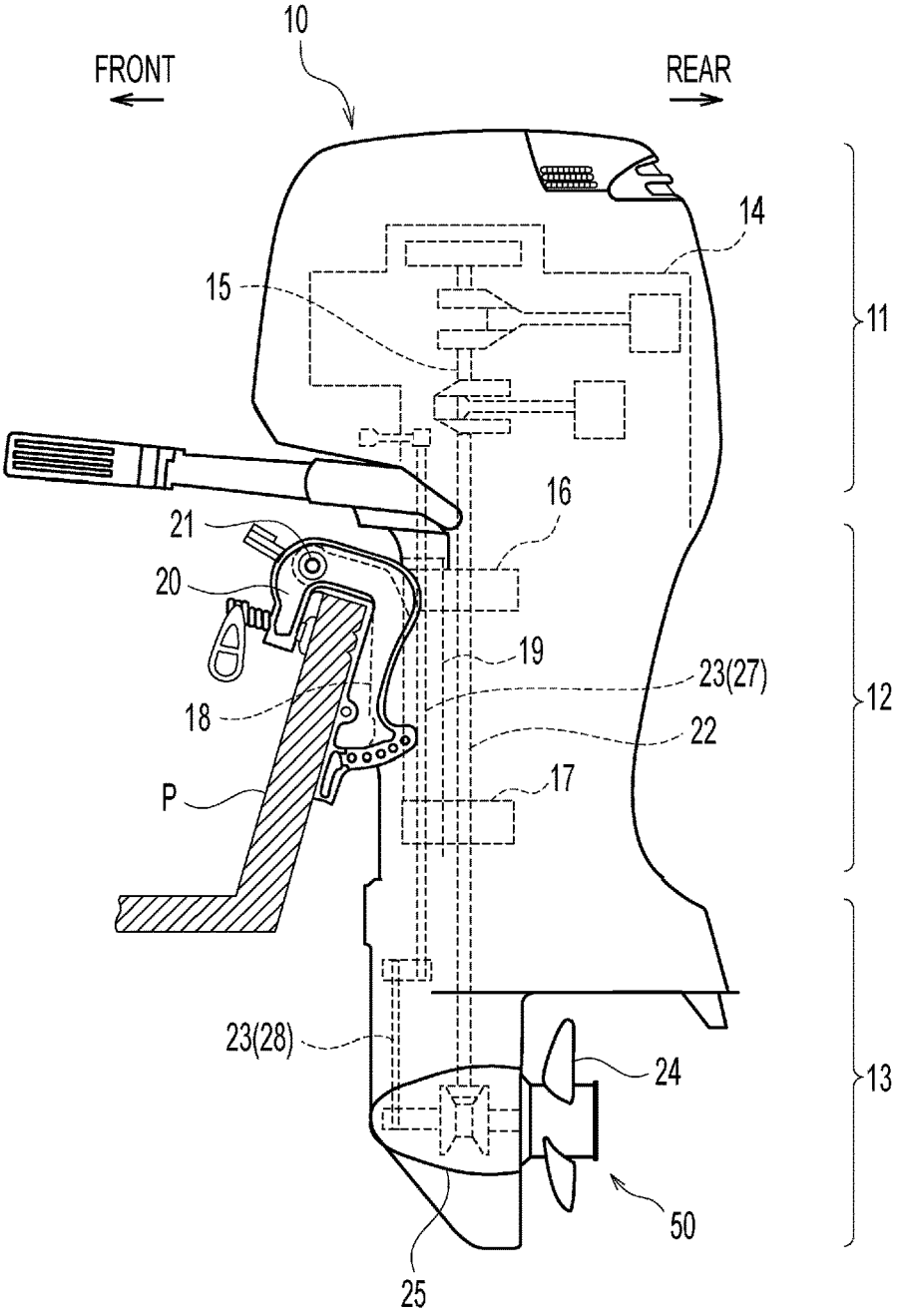
FIG. 1 is a side view illustrating a marine propulsion apparatus as an application of the invention.

FIG. 1 is a left side view illustrating a schematic configuration example of a marine propulsion apparatus according to the present invention, that is, an outboard motor 10. In this case, the outboard motor 10 is fixed to a transom 2 of a hull of the boat 1 in the front side, as shown in the drawing. Note that, in the following description, front and rear directions of the outboard motor 10 and lateral right and left sides of the outboard motor 10 are indicated by respective arrows as necessary in each drawing.

In the entire configuration of the outboard motor 10, an engine unit or power unit 11, a middle unit 12, and a lower unit 13 are sequentially arranged from top to the bottom. In the engine unit 11, an engine 14 is mounted and supported vertically using an engine base such that its crankshaft 15 is directed vertically. Note that, for example, a V-type multi-cylinder engine may be employed as the engine 14. The middle unit 12 is supported by upper and lower mounts 16 and 17 so as to rotate around a support shaft 19 set in a swivel bracket 18 in synchronization. A clamp bracket 20 is provided in both left and right sides of the swivel bracket 18 so that the engine 14 is fixed to the transom 2 of the hull using the clamp bracket 20. The swivel bracket 18 is supported rotatably in a vertical direction with respect to a tilt shaft 21 set in the left-right direction.

In the middle unit 12, the driveshaft 22 connected to a lower end of the crankshaft 15 is penetratingly arranged in a vertical direction, so that a drive force of the driveshaft 22 is transmitted to a propeller shaft described below inside a gear casing of the lower unit 13. In front of the driveshaft 22, a shift rod 23 for switching between forward and backward operations is arranged in parallel in the vertical direction. The shift rod 23 includes upper and lower shift rods 27 and 28. Note that the middle unit 12 has a driveshaft housing for housing the driveshaft 22. In addition, the middle unit 12 is provided with an oil pan for storing oil for lubricating the engine unit 11.

The lower unit 13 has a gear casing 25 housing a plurality of gears for rotatably driving the propeller 24 by virtue of a drive force of the driveshaft 22. A gear installed in the driveshaft 22 extending downward from the middle unit 12 meshes with the gear of the gear casing 25 to finally rotate the propeller 24. However, a power transmission path of the gear unit of the gear casing 25 is switched, that is, shifted by virtue of the shift rod 23.

Figure 2:
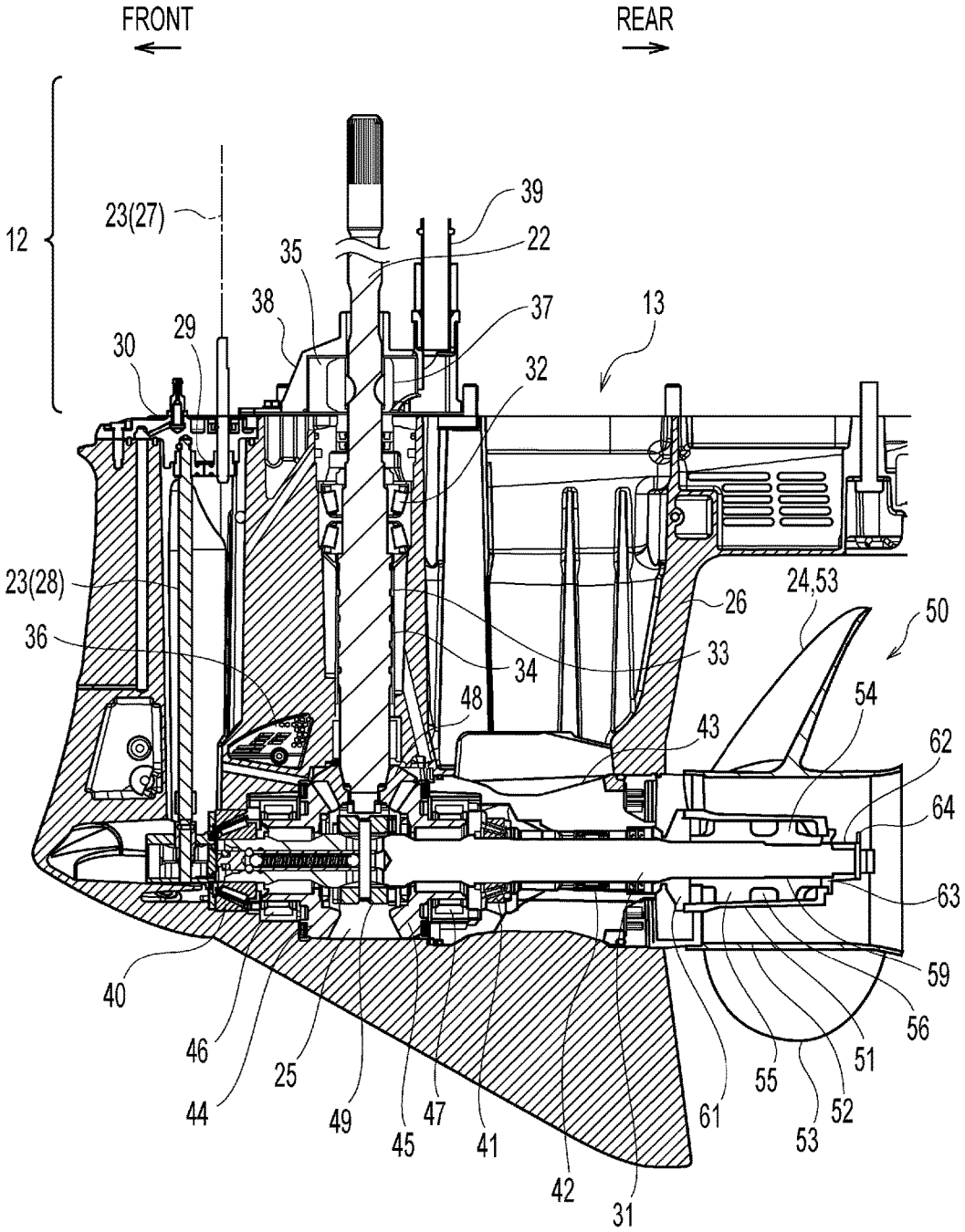
FIG. 2 is a cross-sectional view illustrating an internal structure of a lower unit of a marine propulsion apparatus according to an embodiment of the invention.

FIG. 2 is a vertical cross-sectional view taken along a propeller shaft direction to illustrate the lower unit 13. The gear casing 25 arranged along the front-rear direction in a bullet shape is provided in a lower part of the casing 26 integrally formed as illustrated in FIG. 2. The shift rod 23 is vertically inserted and supported by a tip side of the bullet shape of the gear casing 25 of the casing 26. Note that the shift rod 23 is substantially bisected into an upper shift rod 27 extending from the engine unit 11 to the middle unit 12 and a lower shift rod 28 arranged inside the lower unit 13 as illustrated in FIG. 2. The upper shift rod 27 is rotatably driven by a drive force from an actuator (not shown) provided in the engine unit 11 side through a link mechanism, and its rotation is further transmitted to the lower shift rod 28 through a coupling gear 29 including a pair of driving and driven gears. A coupling portion between the upper and lower shift rods 27 and 28 is held by a shift rod housing 30 fixed to an upper surface of the casing 26. As illustrated in FIG. 2, the shift rod 23, that is, the lower shift rod 28 is vertically installed in a position intersecting an extension part of the axial line of the propeller shaft 31.

As illustrated in FIG. 2, the driveshaft 22 is inserted and supported in the vicinity of a substantial center of the front-rear direction of the casing 26. In this case, the driveshaft 22 is supported rotatably inside the casing 26 in the vicinity of an upper part of the casing 26, for example, by interposing a backrest type tapered roller bearing 32, and is vertically installed such that its lower end reaches the inside of the gear casing 25. A helix or spiral groove 33 is engraved in the lower part of the tapered roller bearing 32 in the driveshaft 22, and a small gap is opened around the groove 33 from the outer circumferential surface of the driveshaft 22, so that a collar 34 is fitted.

As the driveshaft 22 is rotated, the spiral groove 33 has an oil feeding or pumping capability, and an oil circulation path is formed to supply lubricating oil to main parts or members that necessitate lubrication inside the casing 26. Note that a lubricating oil pump for the engine unit 11 is arranged and provided separately from this groove 33.

A coolant pump 35 is installed to cover the driveshaft 22 as seen from the top of the casing 26. This coolant pump 35 receives water from the outside of the outboard motor 10 and supplies a coolant to the engine unit 11 side. In this case, a water inlet port 36 is provided in the vicinity of the front lower side of the casing 26 as illustrated in FIG. 2. Although not shown in details, the coolant pump 35 and the water inlet port 36 are connected to each other with a coolant path inside the casing 26. Note that a cover having a filtering capability against a foreign object or the like is attached to the water inlet port 36. As illustrated in FIG. 2, the water inlet port 36 is arranged between the driveshaft 22 and the lower shift rod 28 in the front-rear direction.

In the coolant pump 35, an impeller 37 is fixed to the driveshaft 22 as illustrated in FIG. 2, so that the impeller 37 is housed in a pump housing 38 of the coolant pump 35. As the driveshaft 22 is rotated, a pressurized coolant is discharged from the coolant pump 35, so that the coolant is fed through the coolant pipe 39 and is finally supplied to the engine unit 11 side.

In the gear casing 25, the propeller shaft 31 is arranged in the front-rear direction and is rotatably supported by a plurality of bearings 40, 41, and 42 as illustrated in FIG. 2. Note that the bearings 41 and 42 are held in the bearing housing 43. A front-rear pair of forward and reverse gears 44 and 45 are rotatably supported by bearings 46 and 47, respectively, while they are arranged coaxially with the propeller shaft 31 under the lower end of the driveshaft 22 and are inserted floatably. The forward and reverse gears 44 and 45 mesh with the driving gear 48 fixed in the lower end of the driveshaft 22 at all times. In this example, the forward gear 44 is disposed in the front side, the reverse gear 45 is disposed in the rear side, and a dog clutch 49 is arranged therebetween.

In the aforementioned configuration, for example, when the boat 1 moves forward, a power transmission path from the forward gear 44 to the propeller shaft 31 through the dog clutch 49 is formed by a shift operation. As the engine 14 starts, its output torque is transmitted to the driveshaft 22, and the propeller shaft 31 is rotated through the forward gear 44. As a result, the propeller 24 is rotated, and a forward thrust force of the outboard motor 10 is generated, so that the boat 1 mounted with the outboard motor 10 moves forward. In addition, when the boat 1 moves backward, the reverse gear 45 and the propeller shaft 31 are connected by the shift operation of the dog clutch 49 reversely to the aforementioned case. In addition, the outboard motor 10 generates a backward thrust force, and the boat 1 moves backward.

In the outboard motor 10 according to the present invention, the propeller unit 50 including the propeller 24 is connected to the propeller shaft 31. As illustrated in FIG. 2, the propeller unit 50 has an inner hub 51 having a substantially cylindrical shape and an outer hub 51 arranged coaxially with the inner hub 51, connected to the inner hub 51, and provided with a plurality of blades 53 on a substantially cylindrical outer circumferential surface. The propeller unit 50 further includes a bushing 54 having a metallic (brass) hollow shaft member 55 provided with ribs formed on the outer circumferential surface as described below and connected to the propeller shaft 31, and a damper 56 formed of an elastic member and arranged between the outer circumferential surface of the hollow shaft member 55 and the inner circumferential surface of the inner hub 51 to cover the outer circumferential surface of the hollow shaft member 55.

Figure 3:
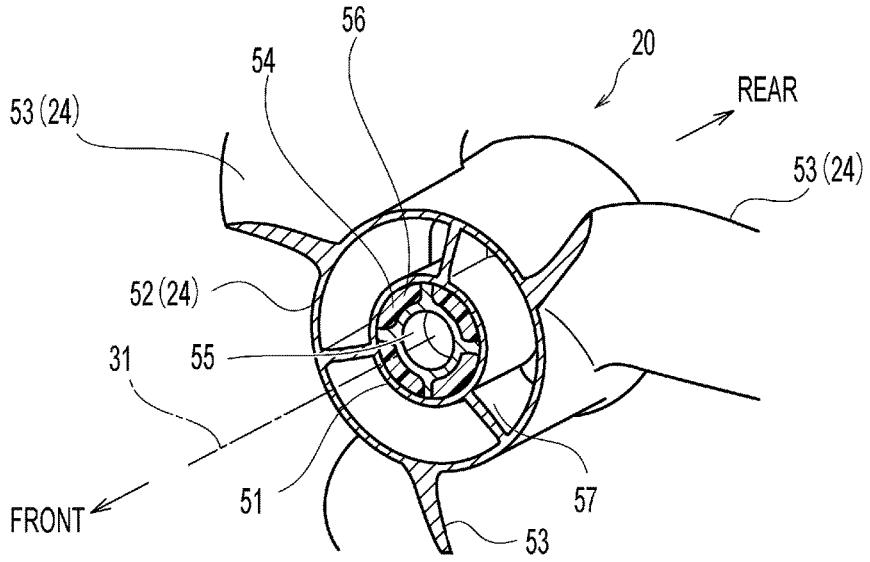
FIG. 3 is a partial cutaway perspective view illustrating a propeller unit of the marine propulsion apparatus according to the invention.

The inner and outer hubs 51 and 52 are formed of metal such as aluminum, stainless steel, and titanium and constitute a dual propeller hub in which the inner and outer hubs 51 and 52 arranged coaxially as illustrated in FIG. 3 are integrally coupled using a plurality of radial ribs or spokes 57. In this example, three blades 53 arranged radially outward of the outer hub 52 are formed integrally.

Figure 4:
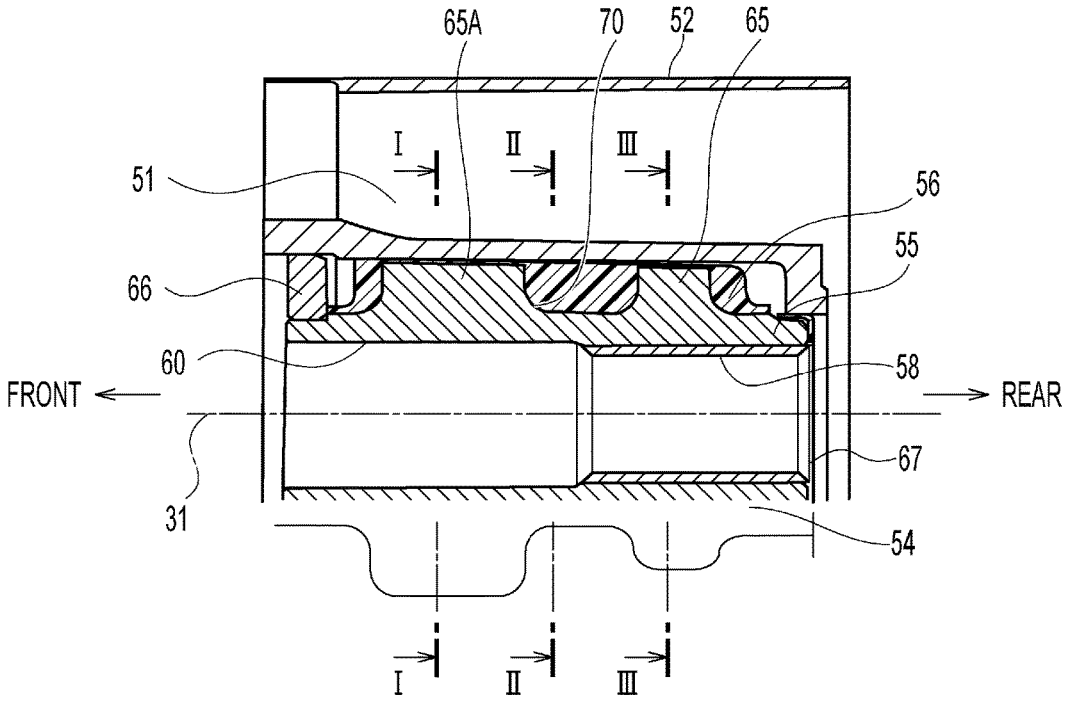
FIG. 4 is a side cross-sectional view illustrating the propeller unit of the marine propulsion apparatus according to the invention.

The bushing 54 is spline-coupled to the propeller shaft 31 through spline teeth formed on the inner circumferential surface of a front half or rear half of the longitudinal direction of the hollow shaft member 55. In this embodiment, the spline teeth 58 are formed on the inner circumferential surface of the rear half of the longitudinal direction of the hollow shaft member 55 as illustrated in FIG. 4. Meanwhile, spline teeth 59 meshing with the spline teeth 58 of the hollow shaft member 55 are provided in the vicinity of the rear end of the propeller shaft 31 (refer to FIG. 2). The spline tooth 58 is not provided in the front half of the longitudinal direction of the hollow shaft member 55 (hereinafter, referred to as a non-spline-toothed portion 60), and propeller shaft 31 is fitted to the non-spline-toothed portion 60 having a cylindrical surface. The propeller shaft 31 and the hollow shaft member 55 are coupled to rotate in synchronization.

Referring to FIG. 2, a bushing stopper 61 fitted to the propeller shaft 31 in a tapered shape is provided in the vicinity of the rear end of the bearing housing 43, and a front end of the hollow shaft member 55 of the bushing 54 mounted on the propeller shaft 31 abuts on the bushing stopper 61. A nut 62 is screwed to the rear end of the propeller shaft 31 and is fastened to allow the hollow shaft member 55 to abut on the bushing stopper 61 by interposing a spacer 63. Note that the nut 62 is fixed using a cotter pin 64.

Figure 5:
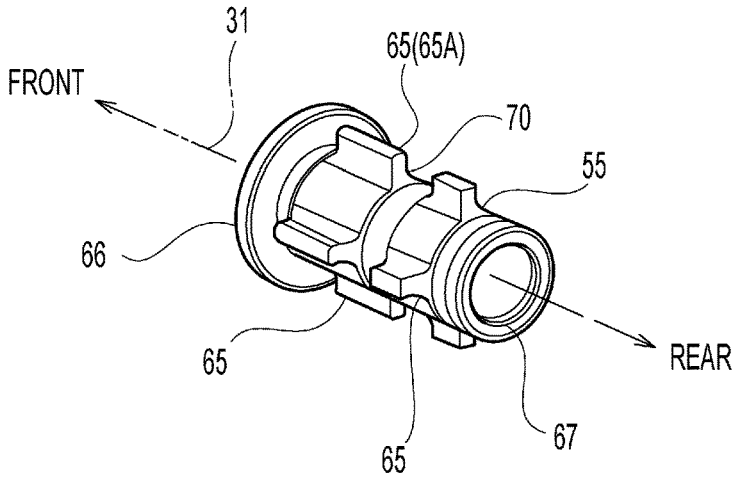
FIG. 5 is a rear perspective view illustrating a hollow shaft member of the propeller unit according to an embodiment of the invention.
Figure 6A:
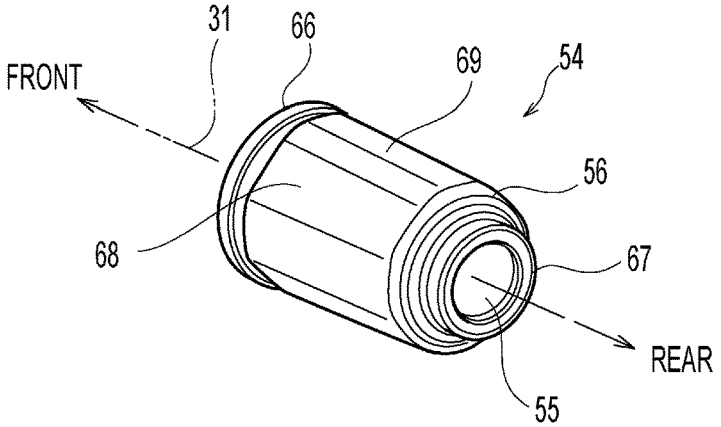
FIG. 6A is a rear perspective view illustrating a bushing in which an outer circumferential surface of the hollow shaft member is covered by a damper according to an embodiment of the invention.
Figure 6B:
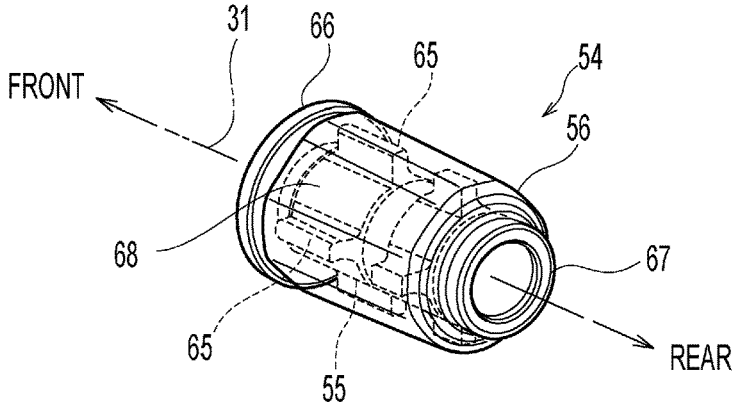
FIG. 6B is a rear perspective view illustrating a bushing in which an outer circumferential surface of the hollow shaft member is covered by a damper according to an embodiment of the invention.
Figure 7:
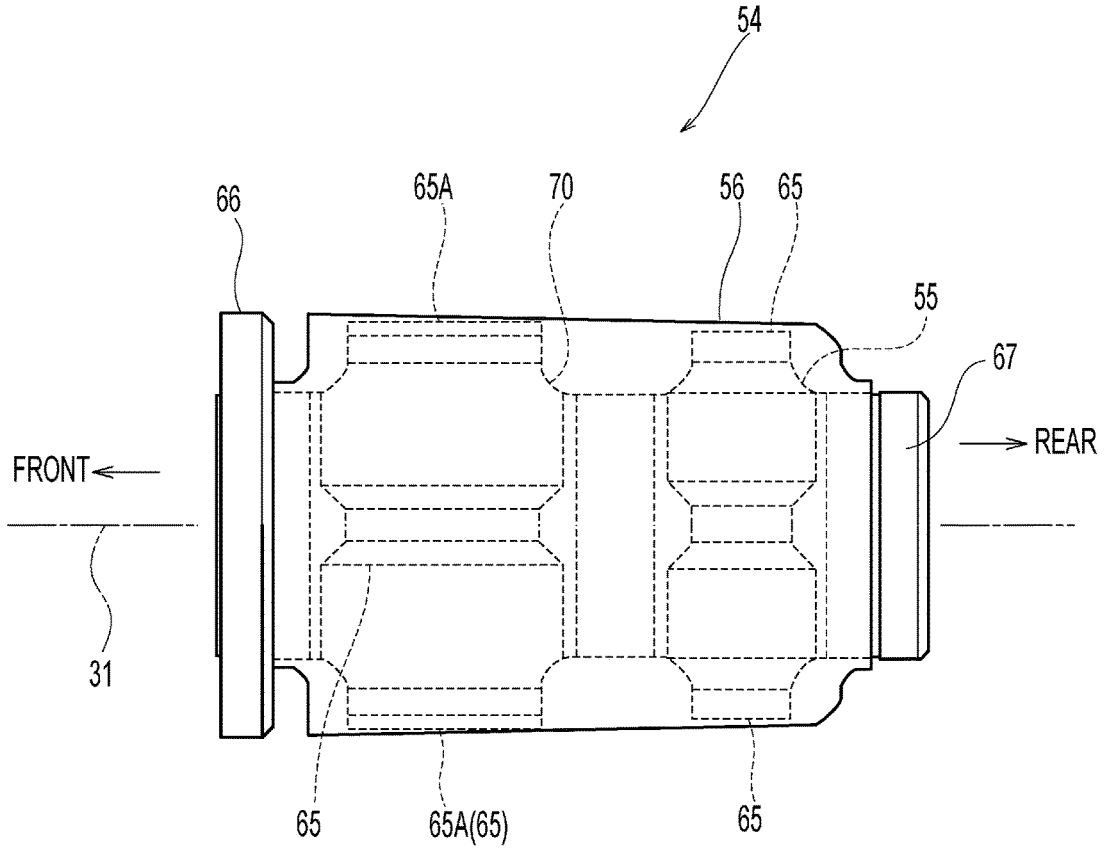
FIG. 7 is a side view illustrating a bushing in which an outer circumferential surface of the hollow shaft member is covered by a damper according to an embodiment of the invention.
Figure 8A:
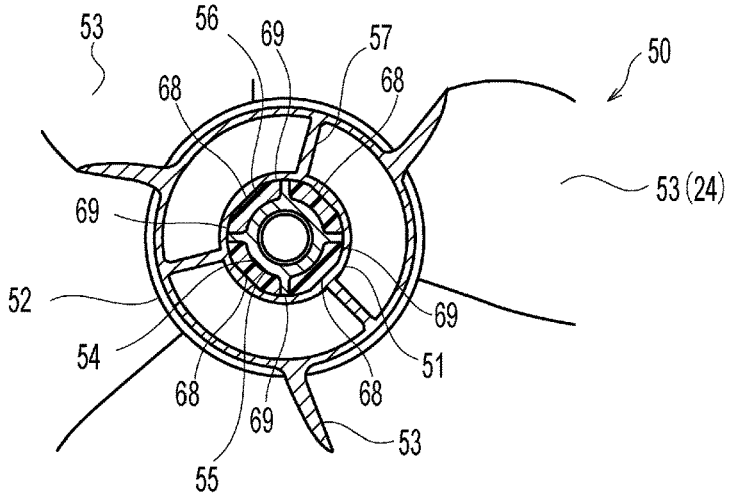
FIG. 8A is a cross-sectional view taken along a line I-I of FIG. 4.

Next, FIG. 5 is a rear perspective view illustrating the hollow shaft member 55. FIGS. 6A, 6B, and 7 are rear perspective views and a side view illustrating the bushing 54 in which the outer circumferential surface of the hollow shaft member 55 is covered by the damper 56. The outer circumferential surface of the hollow shaft member 55 covered by the damper 56 has a substantially cylindrical shape, and a plurality of ribs 65 erected radially from the outer circumferential surface are formed along the longitudinal direction. In this embodiment, as illustrated in FIG. 8A and the like, four ribs 65 are provided to circumferentially quadrisect the outer circumferential surface of the hollow shaft member 55. In addition, a flange 66 and a cap 67 are fitted and mounted to front and rear ends, respectively, of the hollow shaft member 55 and are loosely fitted to the inner circumferential surface of the inner hub 51 in the front and rear ends, respectively.

Figure 8B:
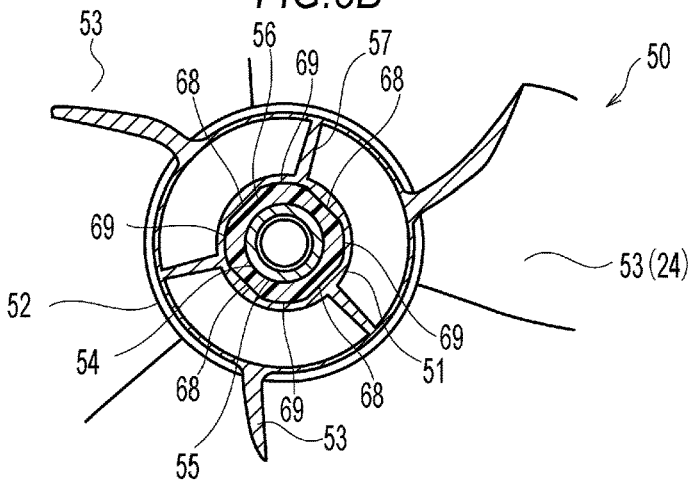
FIG. 8B is a cross-sectional view taken along a line II-II of FIG. 4.
Figure 8C:
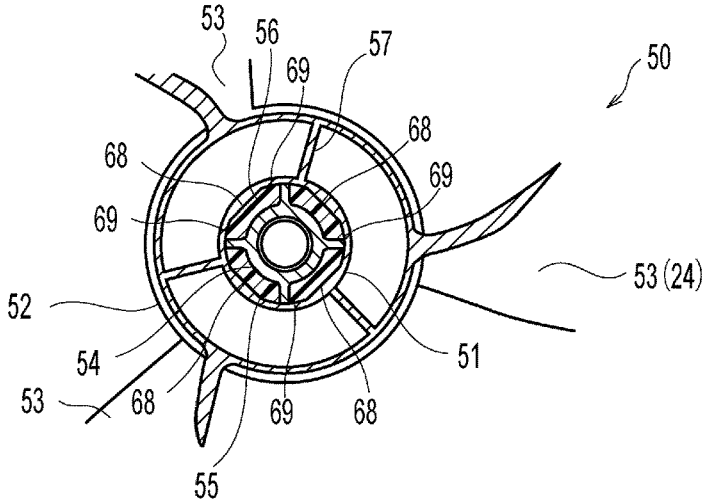
FIG. 8C is a cross-sectional view taken along a line III-III of FIG. 4.

The damper 56 may be integrally molded through insert-molding or the like for the hollow shaft member 55 using an elastic material such as rubber or synthetic rubber. The damper 56 has a deformed tetragonal cross-sectional shape (in this example, tetragon), and its outer circumferential surface has truncated surfaces 68 corresponding to sides of the polygon and curved portions 69 that form corners so as to smoothly connect neighboring sides of the polygon to each other with a suitable curve (with a radius of curvature of the inner diameter of the inner hub 51). As illustrated in FIG. 8A and the like, four ribs 65 are provided to match each curved portion 69, and the ribs 65 are arranged in a cross shape along a diagonal line of the tetragon of the damper 56 as a whole. In this case, the height of the rib 65 is set to be longer than a distance of the truncated surface 68 from a center of the tetragon. The inner circumferential surface of the inner hub 51 is formed to be substantially equal or similar to the outer circumferential surface of the damper 56 as illustrated in FIGS. 8A and 8B in an analogous manner, and the inner hub 51 has a cross-sectional shape substantially equal to that of the deformed tetragonal cross-sectional shape including the truncated surfaces 68 and the curved portions 69 of the damper 56.

The bushing 54 is provided with a breakable portion in a part corresponding to the non-spline-toothed portion 60. Specifically, the breakable portion is formed in a boundary between the non-spline-toothed portion 60 of the hollow shaft member 55 and the spline tooth 58. More specifically, as illustrated in FIG. 5 and the like, the breakable portion includes a notch portion 70 formed in the rib 65 provided on the outer circumference of the hollow shaft member 55. As illustrated in FIG. 4, the notch portion 70 is formed to include the non-spline-toothed portion 60 and the boundary of the spline tooth 58 in the longitudinal direction of the hollow shaft member 55 and is notched to the outer circumferential surface of the hollow shaft member 55. As illustrated in FIG. 5, the notch portion 70 and the outer circumferential surface of the hollow shaft member 55 are connected in a suitable radius of curvature R, so that the notch portion 70 typically has a U-shape as seen in the side view.

Figure 9A:
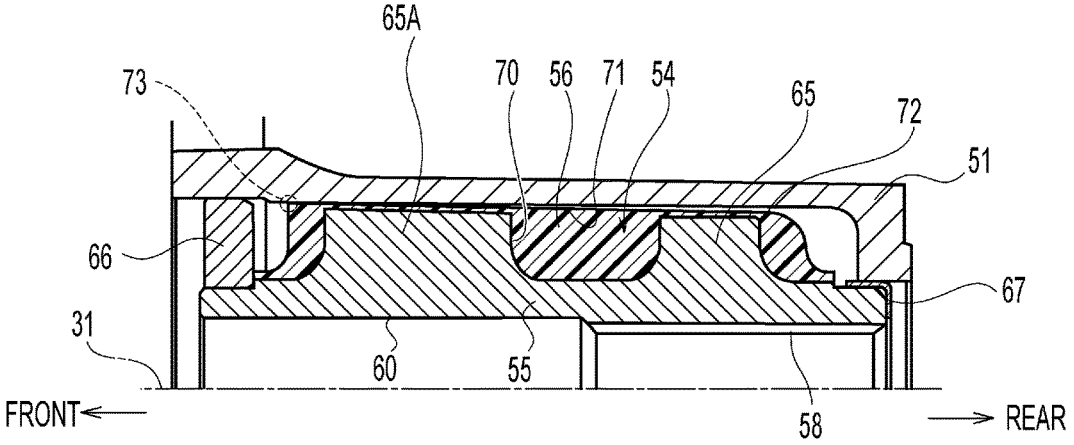
FIG. 9A is a side cross-sectional view illustrating the propeller unit of the marine propulsion apparatus according to the invention in a stop state.

The inner circumferential surface of the inner hub 51 and the bushing 54 are formed in a tapered shape having an inclined surface extending to the front side of the thrust direction of the propeller unit 50, and a slope of the inclined surface of the bushing 54 is larger than a slope of the inclined surface of the inner circumferential surface of the inner hub 51. In FIG. 9A, the inner circumferential surface of the inner hub 51 has a tapered surface 71, and the outer circumferential surface of the damper 56 (curved portion 69)

has a tapered surface 72. The tapered surfaces 71 and 72 share a taper starting point 73 and make contact with each other. Since the slope of the tapered surface 72 of the damper 56 is larger than the slope of the tapered surface 71 of the inner hub 51, a gap therebetween increases to the rear side of the thrust direction from the taper starting point 73.

In the aforementioned configuration, typically, a drive force transmission path from the propeller shaft 31 to the inner hub 51 during sailing is formed such that the drive force is transmitted from the hollow shaft member 55 of the bushing 54 connected to the propeller shaft 31 to the inner hub 51 through the damper 56 formed of an elastic member. In this case, the drive force of the propeller shaft 31 is transmitted to the spline teeth 58 side of the hollow shaft member 55 spline-coupled to the propeller shaft 31. In addition, the drive force from the bushing 54 to the inner hub 51 is transmitted from the non-spline-toothed portion 60 side of the hollow shaft member 55.

Figure 9B:
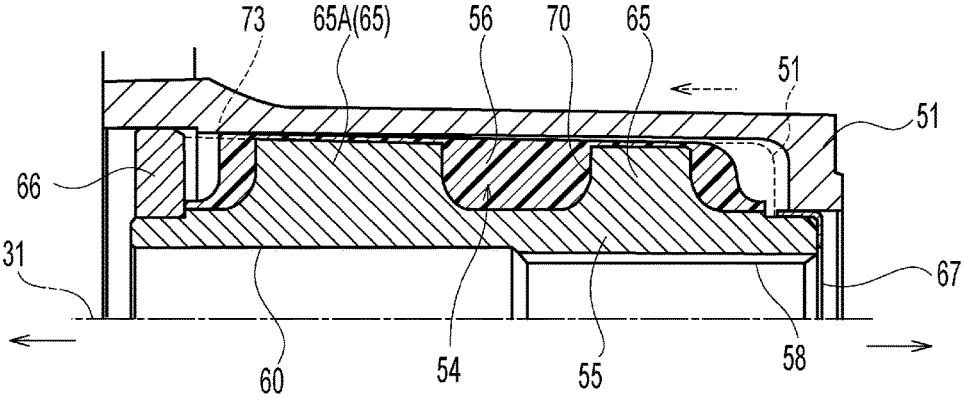
FIG. 9B is a side cross-sectional view illustrating the propeller unit of the marine propulsion apparatus according to an embodiment of the invention in a thrust force transmission state.

In such a thrust force transmission state, the propeller 24 that generates a thrust force, that is, the inner hub 51 moves to the front side with respect to the propeller shaft 31, that is, the bushing 54 as indicated by the dotted line in FIG. 9B. Since the inner hub 51 moves to the front side in this manner, a contact strength between the tapered surfaces 71 and 72 in the non-spline-toothed portion 60 side increases, so that it is possible to effectively transmit the drive force from the bushing 54 to the inner hub 51.

Meanwhile, when an excessive load is applied to the propeller 24 during sailing, the load is transmitted through the following path. Specifically, the load is sequentially transmitted from the propeller 24 to the outer hub 52, to the inner hub 51, to the vicinity of the taper starting point 73 of the damper 56, to the vicinity of the taper starting point 73 of the hollow shaft member 55, to the spline teeth 58 of the hollow shaft member 55, and to the propeller shaft 31. In this case, since the contact strength between the inner hub 51 and the bushing 54 increases in the taper starting point 73 side as described above, the load is input from the inner hub 51 to the non-spline-toothed portion 60 side of the hollow shaft member 55, so that this load deforms the bushing 54 in a rotating manner. The notch portion 70 of the rib 65 provided on the outer circumference of the hollow shaft member 55 serves as a so-called safety fuse. That is, the hollow shaft member 55 is broken by the input load to protect the power transmission system.

The rib 65 covered by the damper 56 of the bushing 54 is forced to follow the damper 56. However, the rib 65 can follow the damper 56 within its elastic deformation range in the area of the curved portion 69 of the damper 56. The rib 65A of the non-spline-toothed portion 60 side (FIG. 9A) is highly erected from the outer circumferential surface of the hollow shaft member 55, that is, approaches the inner circumferential surface of the inner hub 51, and is engaged with the inner circumferential surface of the inner hub 51 corresponding to the truncated surface 68 of the damper 56, so that deformation following the damper 56 is restricted. If an excessive load to the propeller 24 increases to a certain level or higher, the rib 65A is broken by virtue of the safety fuse capability. Since the excessive load to the propeller 24 is instantaneous, a load input higher than that level to the power transmission system is suppressed as the rib 65A is broken. Therefore, components of the power transmission system are protected.

Meanwhile, the ribs 65 of the spline teeth 58 side remain without being broken, so that a power transmission capability is secured for a low-speed sailing level. Since low-speed sailing is allowed even when an excessive load is applied to the propeller 24 during sailing, it is possible to perform sailing without generating a problem in a returning voyage.

The notch portion 70 is formed to include the boundary of the non-spline-toothed portion 60 of the hollow shaft member 55 and the spline teeth 58 so as to provide a safety fuse capability for the part of the rib 65A side. For example, if the boundary between the non-spline-toothed portion 60 and the spline teeth 58 is located in front of the notch portion 70, that is, in the taper starting point 73 side, a part of the excessive load is input to the power transmission system through the spline teeth 58. By setting the boundary within a range of the notch portion 70, it is possible to concentrate an input excessive load to the rib 65A side and guarantee the safety fuse capability.

Since the slope of the tapered surface 72 of the damper 56 is larger than the slope of the tapered surface 71 of the inner hub 51, the inner hub 51 that typically moves to the front side during sailing (FIG. 9B) makes contact. Therefore, a contact strength between the inner hub 51 and the bushing 54 in the taper starting point 73 side increases. As a result, it is possible to promote a load input in the non-spline-toothed portion 60 side of the hollow shaft member 55 from the inner hub 51. Since the notch portion 70 and the tapered surfaces 71 and 72 are provided in this manner, it is possible to clearly set a load input path in the event of an excessive load and control breaking only using a cross-sectional shape of the hollow shaft member 55. Therefore, it is possible to reliably guarantee protection of the power transmission system.

While embodiments of the present invention have been described in details with reference to the accompanying drawings hereinbefore, the embodiments are merely for illustrative purposes to show specific examples of the present invention. A technical scope of the present invention is not limited to the aforementioned embodiments. Various changes may be possible without departing from the spirit and scope of the invention, and they are also included in the technical scope of the invention.

For example, although the damper 56 has a tetragonal shape as a deformed polygonal cross-sectional shape by way of example, other polygons may also be employed.

According to the present invention, when an excessive load is applied to the propeller during sailing, a breakable portion provided in a part corresponding to a non-spline-toothed portion serves as a so-called safety fuse. That is, a hollow shaft member is broken to protect a power transmission system.

What is claimed is:

1. A propeller unit connected to a propeller shaft of a marine propulsion apparatus, comprising:

an inner hub;

an outer hub arranged coaxially with the inner hub, connected to the inner hub, and provided with a plurality of blades on its outer circumferential surface; and a bushing having a hollow shaft member provided with ribs on an outer circumferential surface and connected to the propeller shaft, and a damper formed of an elastic member and arranged to cover an outer circumferential surface of the hollow shaft member between the outer circumferential surface of the hollow shaft member and the inner circumferential surface of the inner hub, wherein the bushing is spline-coupled to the propeller shaft through spline teeth formed on an inner circumferential surface of a front half or rear half of a longitudinal direction of the hollow shaft member, and has a breakable portion provided in a part corresponding to a non-spline-toothed portion.

2. The propeller unit according to claim 1, wherein the breakable portion is formed in a boundary between the non-spline-toothed portion of the hollow shaft member and the spline teeth.

3. The propeller unit according to claim 1, wherein the breakable portion is a notch portion formed in the rib provided on an outer circumference of the hollow shaft member.

4. The propeller unit according to claim 1, wherein a drive force transmission path from the propeller shaft to the inner hub during typical sailing is formed such that the drive force is transmitted from the hollow shaft member of the bushing connected to the propeller shaft to the inner hub through the elastic member, the driving force of the propeller shaft is transmitted to the spline teeth side of the hollow shaft member spline-coupled to the propeller shaft, and the drive force from the bushing to the inner hub is transmitted from the non-spline-toothed portion side of the hollow shaft member.

5. The propeller unit according to claim 4, wherein the inner circumferential surface of the inner hub and the bushing are formed in a tapered shape having an inclined surface extending to a front side of a thrust direction of the propeller unit, and a slope of the inclined surface of the bushing is larger than a slope of the inclined surface of the inner circumferential surface of the inner hub.

* * * * *